US009039961B2

(12) United States Patent
Talonen et al.

(10) Patent No.: US 9,039,961 B2
(45) Date of Patent: May 26, 2015

(54) LOW-NICKEL AUSTENITIC STAINLESS STEEL

(75) Inventors: Juho Talonen, Helsinki (FI); Suresh Kodukula, Tornio (FI); Tero Taulavuori, Tornio (FI)

(73) Assignee: Outokumpu Oyj, Espoo (FI)

( * ) Notice: Subject to any disclaimer, the term of this patent is extended or adjusted under 35 U.S.C. 154(b) by 304 days.

(21) Appl. No.: 13/643,920

(22) PCT Filed: Apr. 18, 2011

(86) PCT No.: PCT/FI2011/050348

§ 371 (c)(1),
(2), (4) Date: Oct. 26, 2012

(87) PCT Pub. No.: WO2011/138503

PCT Pub. Date: Nov. 10, 2011

(65) Prior Publication Data

US 2013/0039802 A1 Feb. 14, 2013

(30) Foreign Application Priority Data

May 6, 2010 (FI) ..... 20100196

(51) Int. Cl.

| | |
|---|---|
| ***C22C 38/58*** | (2006.01) |
| ***C22C 38/42*** | (2006.01) |
| ***C21D 6/00*** | (2006.01) |
| ***C22C 38/00*** | (2006.01) |
| ***C22C 38/02*** | (2006.01) |

(52) U.S. Cl.

CPC ..... *C22C 38/58* (2013.01); *C22C 38/42* (2013.01); *C21D 6/002* (2013.01); *C21D 6/005* (2013.01); *C22C 38/001* (2013.01); *C22C 38/02* (2013.01)

(58) Field of Classification Search

None

See application file for complete search history.

(56) References Cited

FOREIGN PATENT DOCUMENTS

| | | | |
|---|---|---|---|
| EP | 0694626 | A1 | 1/1996 |
| EP | 2025770 | A1 | 2/2009 |
| GB | 1419736 | A | 12/1975 |
| JP | 03-002357 | * | 1/1991 |
| JP | 2009-030128 | * | 2/2009 |
| WO | 9506142 | A1 | 3/1995 |
| WO | 2005045082 | A1 | 5/2005 |
| WO | 2009074205 | A1 | 6/2009 |

OTHER PUBLICATIONS

Machine-English translation of Japanese patent No. 2009-030128, Junichi Hamada et al., Feb. 12, 2009.*

International Search Report, PCT/FI2011/050348, completed Jun. 16, 2011, mailed Jun. 17, 2011, 3 pages.

* cited by examiner

*Primary Examiner* — Deborah Yee

(74) *Attorney, Agent, or Firm* — Chernoff, Vilhauer, McClung & Stenzel, LLP

(57) ABSTRACT

The invention relates to a low-nickel austenitic stainless steel with high resistance to delayed cracking and the use of the steel. The steel contains in weight % 0.02-0.15% carbon, 7-15% manganese, 14-19% chromium, 0.1-4% nickel, 0.1-3% copper, 0.05-0.3% nitrogen, the balance of the steel being iron and inevitable impurities, and the chemical composition range in terms of the sum of carbon and nitrogen contents (C+N) and the measured Md3o-temperature is inside the area defined by the points ABCD which have the following values Point $M_{d30}$° C. C+N % A−80 0.1 B+7 0.1 C−40 0.40 D−80 0.40.

10 Claims, 2 Drawing Sheets

Drawing ratio 2,0 Drawing ratio 2,1

Drawing ratio 2,0 Drawing ratio 2,1

Drawing ratio 2,0 Drawing ratio 2,1

LOW-NICKEL AUSTENITIC STAINLESS STEEL

CROSS-REFERENCE TO RELATED APPLICATION

Figure 1:
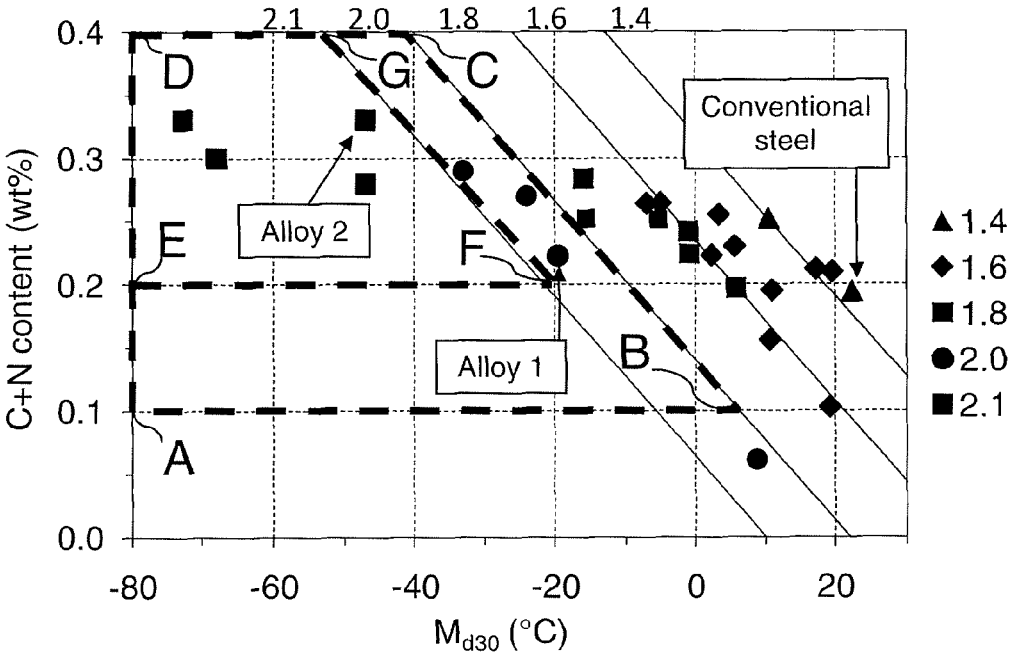

This is a national stage application filed under 35 USC 371 based on International Application No. PCT/FI2011/050348 filed Apr. 18, 2011, and claims priority under 35 USC119 of Finnish Patent Application No. 20100196 filed May 6, 2010.

TECHNICAL FIELD

This invention relates to a highly formable low-nickel austenitic stainless steel, which is highly resistant to delayed cracking compared to low-Ni austenitic steel grades currently on the market. The invention also relates to the use of the steel in metal products manufactured by working methods.

BACKGROUND ART

High fluctuations in the nickel price have increased the interest to low-nickel and nickel-free alternatives of Cr—Ni-alloyed austenitic stainless steels. When describing the element content in the following, the content is in weight %, if not otherwise mentioned. Manganese-alloyed 200-series austenitic stainless steels have generally equal formability compared to Cr—Ni-alloyed 300-series grades, and also their other properties are comparable. However, most manganese-alloyed grades, especially those with particularly low nickel content from 0% to 5%, are susceptible to delayed cracking phenomenon, which prevents their use in applications where severe deep-drawing operations are needed. Another drawback of the low-nickel grades currently available is that they have reduced the chromium content in order to ensure fully austenitic crystal structure. For instance, low-nickel grades with around 1% nickel contain typically only 15% chromium, which impairs their corrosion resistance.

One example of a low-Ni Mn-alloyed steel grade is grade AISI 204 (UNS S20400) that can be made as a modified version by alloying with copper, Cu. The new copper alloyed material in the standard is named as S20431 according to the standard ASTM A 240-09b and EN specified grade 1.4597. These steels are widely used for domestic appliances, shallow pots and pans and other consumer products. However, the currently available steels are very susceptible to delayed cracking, and therefore cannot be used in applications where material is subjected to deep drawing.

Some austenitic stainless steel grades with reduced nickel content designed to be resistant to delayed cracking have been proposed. GB patent 1419736 discloses an unstable austenitic stainless steel with low susceptibility to delayed cracking, which is based on low contents of C and N. However, the steel in question has minimum Ni content specified as 6.5%, impairing the cost-efficiency of the steel.

WO publication 95/06142 discloses an austenitic stainless steel, which is made resistant to delayed cracking by limiting the C and N content and by controlling the $M_{d30}$-temperature describing the austenite stability of the steel. However, the steel of this WO publication contains at the minimum 6% nickel, and is thus not cost efficient.

EP patent 2025770 discloses a nickel-reduced austenitic stainless steel, which is made resistant to delayed cracking by controlling the $M_{d30}$-temperature. However, the steel of this EP patent contains at the minimum 3% nickel, reducing the cost-efficiency of the steel.

In addition, numerous alloys have been proposed to find cost efficient alternatives for conventional Cr—Ni alloyed steel grades. However, none of the existing alloys combine low nickel content (about 1%) and high resistance to delayed cracking.

For instance, EP patent 0694626 discloses an austenitic stainless steel containing 1.5-3.5% nickel. The steel contains 9-11% manganese, which however may impair the surface quality and corrosion resistance of the steel. U.S. Pat. No. 6,274,084 discloses an austenitic stainless steel with 1-4% nickel. U.S. Pat. No. 3,893,850 discloses a nickel-free austenitic stainless steel containing at the minimum 8.06% manganese and no more than 0.14% nitrogen. EP patent 0593158 discloses an austenitic stainless steel containing at least 2.5% nickel, thus not exhibiting optimum cost-efficiency. Furthermore, none of the above-mentioned steels has been designed to be resistant to delayed cracking, which limits their use in such applications where severe forming operations need to be carried out.

DISCLOSURE OF THE INVENTION

The object of the present invention is to eliminate some drawbacks of the prior art and to provide a low-nickel austenitic stainless steel with substantially lower susceptibility to delayed cracking compared to the low-nickel stainless steels currently on the market. The resistance to the delayed cracking is ensured by carefully designed chemical composition of the steel, exhibiting an optimum combination of austenite stability and carbon and nitrogen content. The object of the present invention is also the use of the steel in metal products manufactured by working methods, in which methods the delayed cracking can be occurred. The essential features of the invention are enlisted in the appended claims.

The preferred chemical composition of the austenitic stainless steel of the invention is as follows (in weight %):

0.02-0.15% C
0.1-2% Si
7-15% Mn
14-19% Cr
0.1-4% Ni
0.1-3% Cu
0.05-0.35% N,
the rest being iron and inevitable impurities.

The steel of the invention may optionally contain at least one of the following group: up to 3% molybdenum (Mo), up to 0.5% titanium (Ti), up to 0.5% niobium (Nb), up to 0.5% tungsten (W), up to 0.5% vanadium (V), up to 50 ppm boron (B) and/or up to 0.05% aluminum (Al).

The steel of the invention exhibits the following properties:

Yield strength $R_{p0.2}$% is higher than 260 MPa,
Ultimate tensile strength $R_m$ is higher than 550 MPa,
Elongation to fracture $A_{80mm}$ is higher than 40%,
Pitting resistance equivalent PRE (PRE=% Cr+3.3% Mo+16% N) is higher than 17.

The steel of the invention exhibits that a drawing ratio up to at least 2.0 or even higher is achieved in deep drawing without occurrence of delayed cracking. The drawing ratio is defined as the ratio of the diameters of a circular blank having a varying diameter and a punch with a constant diameter used in the deep drawing operation. The austenitic stainless steel of the invention can be used for the resistance to the delayed cracking in metal products manufactured by the working methods of deep drawing, stretch forming, bending, spinning, hydroforming and/or roll forming or by any combination of these working methods.

The effects and the contents in weight % of the elements for the austenitic stainless steel of the invention are described in the following:

Carbon (C) is a valuable austenite forming and stabilizing element, which enables reduced use of expensive elements Ni, Mn and Cu. The upper limit for carbon alloying is set by the risk of carbide precipitation, which deteriorates the corrosion resistance of the steel. Therefore, the carbon content shall be limited below 0.15%, preferably below 0.12% and suitably below 0.1%. The reduction of the carbon content to low levels by the decarburization process is non-economical, and therefore, the carbon content shall not be less than 0.02%. Limiting the carbon content to low levels increases also the need for other expensive austenite formers and stabilizers.

Silicon (Si) is added to stainless steels for deoxidizing purposes in the melt shop and should not be below 0.1%. Because silicon is a ferrite forming element, its content must be limited below 2%, preferably below 1%.

Manganese (Mn) is a key element of the invented steel, ensuring the stable austenitic crystal structure and enabling the reduction of the use of more expensive nickel. Manganese also increases the solubility of nitrogen to the steel. In order to achieve completely austenitic and stable enough crystal structure with as low nickel alloying as possible, the manganese content shall be higher than 7%. A high manganese content makes the decarburization process of the steel more difficult, impairs the surface quality and reduces the corrosion resistance of the steel. Therefore the manganese content shall be less than 15%, preferably less than 10%.

Chromium (Cr) is responsible of ensuring corrosion resistance of the steel. Chromium also stabilizes the austenitic structure, and is thus important in terms of avoiding the delayed cracking phenomenon. Therefore, the chromium content shall be at the minimum 14%. By increasing the content from this level the corrosion resistance of the steel can be improved. Chromium is a ferrite forming element. Therefore, increasing the chromium content increases the need for expensive austenite formers Ni, Mn, Ni or necessitates impractically high C and N contents. Therefore, the chromium content shall be lower than 19%, preferably lower than 17.5%.

Nickel (Ni) is a strong austenite former and stabilizer. However, it is an expensive element, and therefore, in order to maintain cost-efficiency of the invented steel the upper limit for the nickel alloying shall be 4%. Preferably, to further improve the cost-efficiency, the nickel content shall be below 2%, suitably 1.2%. Very low nickel contents would necessitate impractically high alloying with the other austenite forming and stabilizing elements. Therefore, the nickel content shall be preferably higher than 0.5% and more preferably higher than 1%.

Copper (Cu) can be used as a cheaper substitute for nickel as austenite former and stabilizer. The copper content shall not be higher than 3% due to loss of hot ductility. Preferably, the copper content shall not exceed 2.4%.

Nitrogen (N) is a strong austenite former and stabilizer. Therefore, nitrogen alloying improves the cost efficiency of the invented steel by enabling lower use of nickel, copper and manganese. In order to ensure reasonably low use of the above-mentioned alloying elements, nitrogen content shall be at least 0.05%, preferably more than 0.15%. High nitrogen contents increase the strength of the steel and thus make forming operations more difficult. Furthermore, risk of nitride precipitation increases with increasing nitrogen content. For these reasons, the nitrogen content shall not exceed 0.35%, preferably the nitrogen content shall be lower than 0.28%.

Molybdenum (Mo) is an optional element, which can be added to improve the corrosion resistance of the steel. However, due to the high cost, the Mo content of the steel shall be below 3%.

Figure 2:
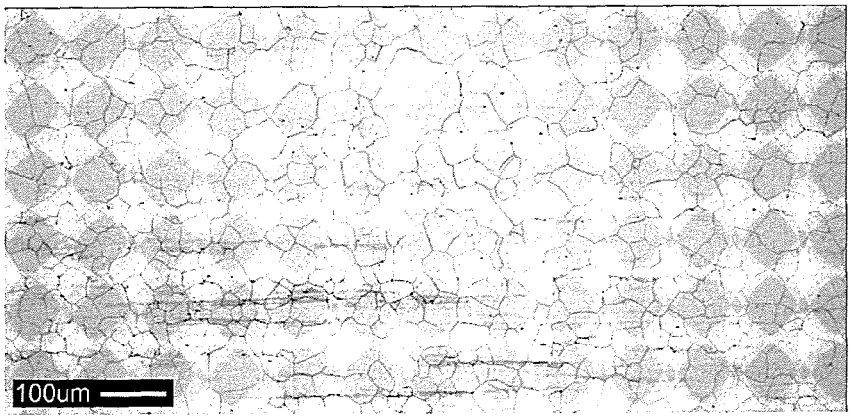
Figure 3:
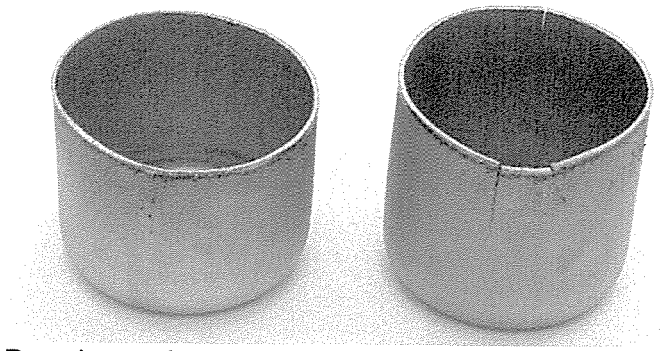
Figure 4:
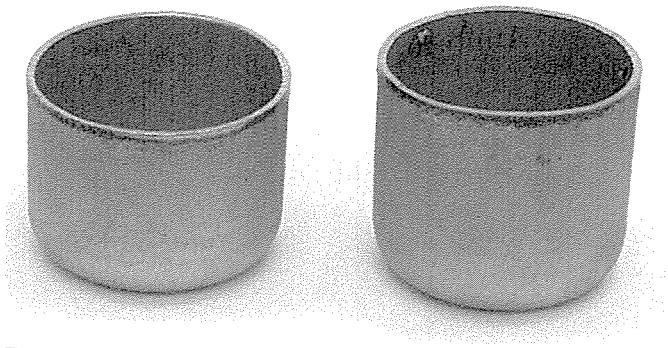
Figure 5:
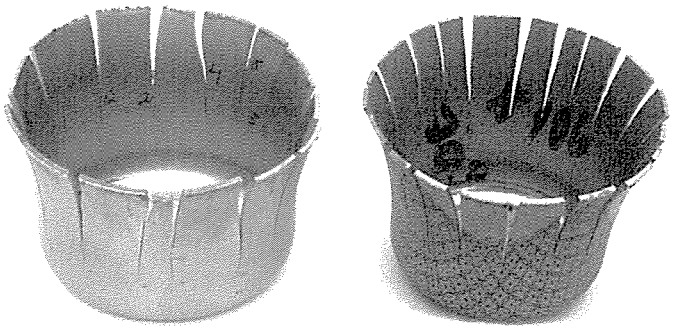

The present invention is described in more details referring to the following drawings, in which FIG. 1 illustrates the chemical composition range of the steel of the invention in terms of the sum of carbon and nitrogen contents (C+N) and the measured $M_{d30}$-temperature, FIG. 2 shows the microstructure of alloy 2 of the table 1 for the steel of the invention, FIG. 3 shows cups deep-drawn from the steel of the invention (alloy 1), FIG. 4 shows cups deep-drawn from the steel of the invention (alloy 2), FIG. 5 shows cups deep-drawn from a conventional steel containing 1.1% nickel.

In addition to the above-mentioned ranges of individual alloying elements, the combination of the $M_{d30}$-temperature and the sum of carbon and nitrogen contents (C+N) of the steel shall be adjusted so that the combination is inside the area defined by the area ABCD in FIG. 1. The points ABCD in FIG. 1 have the values of

| Point | $M_{d30}$ ° C. | C + N % |
|---|---|---|
| A | −80 | 0.1 |
| B | +7 | 0.1 |
| C | −40 | 0.40 |
| D | −80 | 0.40. |

The $M_{d30}$-temperature is defined as the temperature at which 50% strain-induced martensite is formed at 0.3 true plastic tensile strain. Various empirical formulas have been proposed for calculating the $M_{d30}$-temperature. It is noteworthy that none of them is accurate for the invented steel having high Mn-content. Therefore, it is referred to $M_{30}$-temperatures, which have been experimentally measured for the steel of the invention.

DESCRIPTION OF EXPERIMENTS

For testing the steel of the invention several low-Ni Mn-alloyed austenitic stainless steels were produced as 60 kg small-scale heats. Cast ingots were hot rolled and cold rolled down to thicknesses ranging between 1.2 and 1.5 mm. Nickel content of the steels ranged between 1 and 4.5%. Some typical commercially available grades, known to be susceptible to delayed cracking, were also included in the tests. Test materials' susceptibility to delayed cracking was studied by means of Swift cup tests, where circular blanks of varying diameters were deep drawn to cups by using a cylindrical punch.

Austenite stabilities of the steels, denoting material's tendency to transform to strain-induced martensite phase, were determined by measuring the $M_{d30}$-temperatures of the steels experimentally. Tensile test samples were strained to 0.3 true plastic strain at various constant temperatures, and the martensite contents were measured by using a Ferritescope, a device which measures the content of ferromagnetic phase in the material. Ferritescope readings were converted to martensite contents by multiplying by the calibration constant of 1.7. Values of the $M_{d30}$-temperature were determined based on experimental results by regression analysis.

Because experimental determination of the $M_{d30}$ temperature is tedious, for some materials the $M_{d30}$-temperatures were determined by using an empirical formula derived by regression analysis of the experimental results.

FIG. 1 presents a summary of the results. Each data point in the diagram represents a single test material. The symbol (1.4, 1.6, 1.8, 2.0 and 2.1) used indicates the highest drawing ratio to which the material could be deep drawn without the occurrence of delayed cracking within 2 months from the deep drawing operation. The diagonal lines were outlined based on the experimental data points to better illustrate the effects of the $M_{d30}$-temperature and the sum of carbon and nitrogen contents of the steel (C+N).

Clearly, the experimental results show that the risk of delayed cracking is dependent on the combination of the $M_{d30}$-temperature and the sum of carbon and nitrogen contents (C+N) of the steel. The lower the $M_{d30}$-temperature, the carbon content and the nitrogen content were, the lower was the risk of cracking. The developed diagram presented in FIG. 1 was utilized to design the chemical composition of the steel of the present invention so that the desired resistance to delayed cracking was achieved by minimum raw material cost.

Two typical chemical compositions of the invented steel are shown and compared to conventional 1% Ni steel susceptible to delayed cracking in Table 1. Alloy 1 lies within the range ABCD of FIG. 1 and could be deep drawn to drawing ratio of 2.0 without the occurrence of delayed cracking. Alloy 2 lies within the range DEFG of FIG. 1, and could be deep drawn to drawing ratio of 2.1 without the occurrence of delayed cracking. The conventional steel could be drawn only to the drawing ratio of 1.4. FIGS. 3, 4 and 5 show cup samples deep-drawn from alloy 1, alloy 2 and a conventional steel, respectively.

TABLE 1

| | C % | Si % | Mn % | Cr % | Ni % | Cu % | N % | $M_{d30}$ (° C.) |
|---|---|---|---|---|---|---|---|---|
| Alloy 1 | 0.08 | 0.4 | 8.9 | 15.6 | 1.6 | 2.2 | 0.14 | −20 |
| Alloy 2 | 0.10 | 0.3 | 9.1 | 17.0 | 1.0 | 2.0 | 0.23 | −47 |
| Conventional steel | 0.08 | 0.4 | 9.0 | 15.2 | 1.1 | 1.7 | 0.12 | 23 |

Another important feature of the invented steel is that its chromium content can be increased up to 17% without the risk of formation of δ-ferrite, as in the case of the Alloy 2. In the conventional low-nickel steels containing around 1% nickel the chromium content has to be limited to 15% in order to avoid the presence of δ-ferrite, which would cause problems during hot rolling of the steel. The higher chromium content of the invented steel enables higher corrosion resistance compared to the conventional steels. For instance, the Alloy 2, despite its high Cr content, did not contain any δ-ferrite. Consequently, the Alloy 2 could be hot rolled without the occurrence of edge cracking of hot bands. FIG. 2 shows the fully austenitic microstructure of the Alloy 2 after cold rolling.

The invention claimed is:

1. Low-nickel austenitic stainless steel with high resistance to delayed cracking wherein the steel contains in weight % 0.02-0.15% carbon, 7-15% manganese, 14-19% chromium, 0.1-4% nickel, 0.1-3% copper, 0.05-0.35% nitrogen, the balance of the steel being iron and inevitable impurities, and a drawing ratio at least 2.0 in deep drawing is achieved to the steel without occurrence of delayed cracking, and the combination of the sum of carbon and nitrogen contents (C+N) and the austenite stability determined by experimentally measured $M_{d30}$-temperature of the steel is inside the area defined by the points ABCD which have the following values

| Point | $M_{d30}$ ° C. | C + N % |
|---|---|---|
| A | −80 | 0.1 |
| B | +7 | 0.1 |
| C | −40 | 0.40 |
| D | −80 | 0.40. |

2. Low-nickel austenitic stainless steel according to the claim 1, wherein the steel contains 15-17.5% chromium.

3. Low-nickel austenitic stainless steel according to the claim 1, wherein the steel contains 7-10% manganese.

4. Low-nickel austenitic stainless steel according to the claim 1, wherein the steel contains 1-2% nickel.

5. Low-nickel austenitic stainless steel according to claim 1, wherein the steel contains 0.1-2.4% copper.

6. Low-nickel austenitic stainless steel according to the claim 1, wherein the steel optionally contains at least one of the following group: up to 3% molybdenum, up to 0.5% titanium, up to 0.5% niobium, up to 0.5% tungsten, up to 0.5% vanadium, up to 50 ppm boron and/or up to 0.05% aluminum.

7. Low-nickel austenitic stainless steel according to claim 1, wherein the yield strength $R_{p0.2}$ is higher than 260 MPa and the ultimate tensile strength $R_m$ is higher than 550 MPa.

8. Low-nickel austenitic stainless steel according to claim 1, wherein the elongation to fracture $A_{80\ mm}$ is higher than 40%.

9. Low-nickel austenitic stainless steel according to claim 1, wherein the pitting resistance equivalent PRE is higher than 17.

10. Low-nickel austenitic stainless steel according to claim 1, wherein a drawing ratio at least 2.0 in deep drawing is achieved to the steel without occurrence of delayed cracking, and the combination of the sum of carbon and nitrogen contents (C+N) and the austenite stability determined by experimentally measured $M_{d30}$-temperature of the steel is inside the area defined by the points DEFG which have the following values

| Point | $M_{d30}$ ° C. | C + N % |
|---|---|---|
| D | −80 | 0.40 |
| E | −80 | 0.2 |
| F | −20 | 0.2 |
| G | −53 | 0.40. |

* * * * *